US005546925A

United States Patent [19]

Knight et al.

[11] Patent Number: 5,546,925

[45] Date of Patent: Aug. 20, 1996

[54] INSHOT FUEL BURNER NOX REDUCTION DEVICE WITH INTEGRAL POSITIONING SUPPORT STRUCTURE

[75] Inventors: John T. Knight, Fort Smith; Joey W. Huffaker, Rudy; Michael B. Rinke, Van Buren, all of Ark.

[73] Assignee: Rheem Manufacturing Company, New York, N.Y.

[21] Appl. No.: 513,132

[22] Filed: Aug. 9, 1995

[51] Int. Cl.[6] ..... F24H 3/02

[52] U.S. Cl. ..... 126/110 R; 126/91 A; 126/91 R; 126/92 AC; 431/353; 431/347

[58] Field of Search ..... 431/353, 329, 431/350, 352, 354, 351, 7, 170, 326, 347, 171; 126/116 R, 92 C, 92 AC, 91 A, 110 K, 91 R

[56] References Cited

U.S. PATENT DOCUMENTS

| | | | |
|---|---|---|---|
| 2,059,523 | 11/1936 | Hepburn et al. | 126/91 |
| 2,701,608 | 2/1955 | Johnson | 158/1 |
| 3,980,069 | 9/1976 | Butlak et al. | 126/91 A |
| 4,616,994 | 10/1986 | Tomlinson | 431/347 |
| 4,619,604 | 10/1986 | Pickering | 431/353 |
| 4,904,179 | 2/1990 | Drago et al. | 431/2 |
| 5,333,597 | 8/1994 | Kirkpatrick et al. | 126/110 R |
| 5,370,529 | 12/1994 | Lu et al. | 431/353 |

*Primary Examiner*—Larry Jones
*Attorney, Agent, or Firm*—Konneker & Smith

[57] ABSTRACT

A fuel fired, forced air, draft induced heating furnace is provided with NOx reduction apparatus associated with a plurality of combustor tubes forming a portion of its heat exchanger structure. In-shot type fuel burners are spaced apart from and face the open inlet ends of horizontal combustion sections of the combustor tubes. The NOx reduction apparatus includes a plurality of insert members received in inlet end portions of the combustor tubes. Each insert member is formed from a single sheet of metal mesh material and has a hollow, open-ended body portion coaxially received in its associated combustor tube and spaced laterally inwardly from its interior side surface, and a circumferentially spaced plurality of integral, laterally outwardly projecting support rib portions that slidably engage the interior side surface of the combustor tube, thereby automatically maintaining the insert member in a coaxial relationship with the combustor tube regardless of the positional orientation of the tube. To axially retain the insert within the combustor tube, an end portion of one of the centering ribs has a lateral notch that receives a rod anchored to and extending transversely across the inlet end portion of the combustor tube.

27 Claims, 5 Drawing Sheets

INSHOT FUEL BURNER NOX REDUCTION DEVICE WITH INTEGRAL POSITIONING SUPPORT STRUCTURE

BACKGROUND OF THE INVENTION

The present invention generally relates to fuel-fired heating appliances, such as furnaces, water heaters and boilers and, in a preferred embodiment thereof, more particularly relates to apparatus and methods for reducing NOx emissions generated by the combustion systems in such appliances.

Nitrogen oxide (NOx) emissions in fuel-fired heating appliances, such as furnaces, water heaters and boilers, are a product of the combustion process, and are formed when the combustion reaction takes place at high temperature conditions typically encountered in such heating appliances. NOx emissions became an environmental issue in the late 1960's and early 1970's due to their detrimental role in atmospheric visibility, photochemical smog and acid deposition. Regulations in the subsequent decade led to significantly reduced amounts of NOx emissions.

Current SCAQMD (South Coast Air Quality Management District) regulations for residential furnaces and water heaters limit NOx emissions to 40 ng/j of useful heat generated by these types of fuel-fired appliances. Growing environmental concern is leading to even more stringent regulation of NOx emissions. For example, regulations currently being proposed by SCAQMD for water heaters and boilers limit NOx emission levels to 30 ppm at 3% oxygen, which is approximately 20.5 ng/j for middle efficiency water heaters and boilers. Conventional fuel-fired appliance combustion systems are not currently capable of meeting these more stringent limitations. For example, a typical in-shot burner system typically employed in these types of fuel-fired appliances produces NOx emission levels in the range of from about 50 ng/j to about 70 ng/j.

One technique currently used to lower NOx emissions in fuel-fired heating appliances is to position a heat absorbing flame insert within the burner flame path for "quenching" purposes. The resulting lowered combustion flame temperature results in lowered NOx emission rates. For example, as shown in U.S. Pat. No. 5,146,910, flame cooling can be achieved by placing an insert within the burner flame zone. The insert receives heat from the flame and radiates heat away to thereby cool the flame. Using this quenching technique, gas furnaces with flame inserts are now in commercial production and have NOx emission rates of somewhat less than about 40 ng/j.

Flame insert methods are relatively easy and inexpensive to implement. However, NOx reduction achieved by existing flame inserts is rather limited because conventional flame insert designs are operative solely through a flame cooling mechanism and, for a given combustion system, only limited flame cooling can be realized without jeopardizing the combustion process itself. Due to this practical limitation, existing flame inserts are able to reduce NOx emissions to about 30 ng/j—considerably short of the proposed emission limitation set forth above.

Some advanced combustion systems such as infrared/porous matrix surface burners, catalytic combustion and fuel/air staging could reach a very low NOx emission level in compliance with these proposed emission standards, but these methods tend to be quite expensive and usually require extensive system modification. Accordingly, they are not suited for retrofitting existing combustion systems to achieve the desired substantial reduction in system NOx emissions.

A particularly effective, retrofittable NOx reducing apparatus for this general application is illustrated and described in U.S. Pat. No. 5,370,529 to Lu et al and comprises a tubular metal mesh insert which is coaxially held in place within an inlet end portion of a fuel-fired furnace combustor tube by an elongated solid metal support member longitudinally extending through the interior of the tube. A first transverse end of the support member is removably secured to a rod transversely extending across the inlet end of the combustor tube, while an opposite transverse end of the support member slidably engages the interior side surface of the combustor tube. The mesh insert is laterally spaced inwardly from the inner side surface of the combustor tube and functions to receive the incoming burner flame in a manner substantially reducing the NOx emissions of the furnace during operation thereof.

While this NOx reduction insert structure operates to advantageously reduce the NOx emissions to below 20 ng/j, it carries with it two limitations. First, the insert structure is defined by two separate structures—the metal mesh tube, and its associated solid metal support member. This, of course, increases the production cost of the overall NOx reducing structure. Second, this NOx reducing structure must be installed in its associated combustor tube in a manner such that the inner end of its support member portion faces downwardly and rests on a bottom side portion of the interior surface of the combustion tube. Otherwise, the necessary centering of the metal mesh tube within the combustor tube cannot be achieved. Accordingly, the NOx reducing structure is not a multi-positional structure, and must be modified (by changing the orientation of the rod to which the support member attaches) to accommodate different orientations of its associated combustor tube.

From the foregoing it can readily be seen that it would be desirable to provide an improved NOx reducing insert structure that functioned in a manner generally similarly to the structure shown in U.S. Pat. 5,370,529 while at the same eliminating the two previously mentioned limitations associated therewith. It is accordingly an object of the present invention to provide such an improved NOx reducing structure.

SUMMARY OF THE INVENTION

In carrying out principles of the present invention, in accordance with a preferred embodiment thereof, a reduced NOx emission combustion system is incorporated in a fuel-fired heating appliance, representatively a forced air furnace.

The combustion system includes a combustor tube having an open inlet end and an essentially straight combustion section longitudinally extending inwardly from the open inlet. A fuel burner, representatively of the in-shot type, is spaced outwardly apart from the inlet end of the combustor tube and is operative to inject a flame and resulting hot combustion gases into the open inlet end for flow through the combustion section in a manner drawing ambient secondary combustion air into the combustion section around the flame.

Utilized in conjunction with the combustor tube is specially designed NOx reducing apparatus that embodies principles of the present invention. The apparatus includes a NOx reducing insert member formed from a metal mesh material, preferably from a single sheet of Iconel 601 wire mesh, and having a hollow body portion extending along an axis and opposite open ends longitudinally spaced apart along the axis, and a circumferentially spaced plurality of ribs projecting laterally outwardly from the body portion. The NOx reducing insert member is received within the combustion section of the combustor tube with the ribs slidably engaging the interior side surface of the combustion section and maintaining the body portion in a coaxial, laterally inwardly spaced relationship with the combustion section.

Cooperatively engaged means on the combustion section and the NOx reducing insert member function to prevent appreciable axial movement of the NOx reducing insert member within the combustion section. Preferably, the burner flame has a peripheral reaction zone, and the metal mesh material in the insert device body portion is position to axially intercept and contact the peripheral reaction zone of the flame.

Preferably, the cross-section of the hollow body portion of the NOx reducing insert device is circular, but may alternatively have a convex polygonal shape such as rectangular or triangular. Representatively, the cooperatively engaged means include a notch formed in an end portion of one of the insert device ribs and removably receiving a rod member fixed to and transversely extending across the inlet end of the combustor tube.

The NOx reducing insert member of the present invention is advantageously formed from a single piece of material and includes the aforementioned integral centering ribs. Due to the use of these integral centering ribs, the insert member is maintained in a coaxial, laterally inset relationship with the surrounding combustor tube section regardless of the positional orientation of the combustor tube.

DETAILED DESCRIPTION

Figure 1:
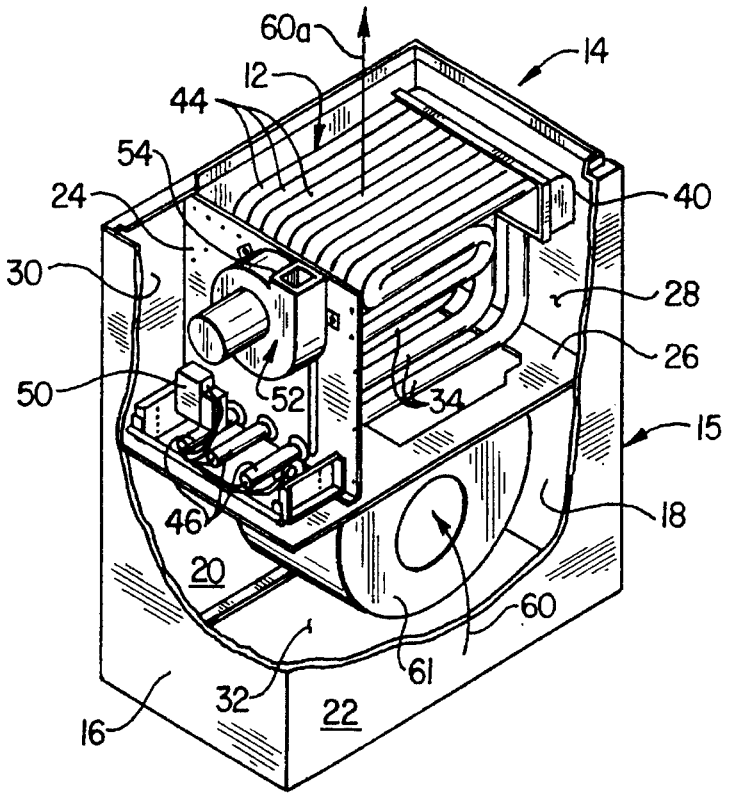
FIG. 1 is a partially cut away perspective view of a representative forced air, fuel-fired furnace incorporating therein specially designed NOx reducing apparatus embodying principles of the present invention.
Figure 2:
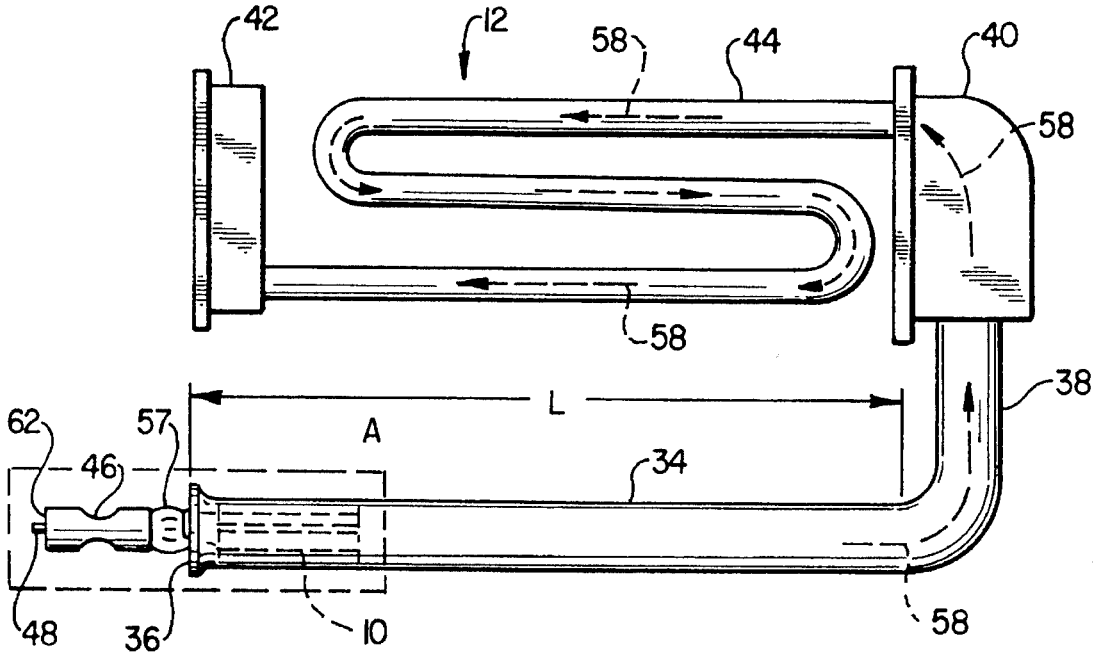
FIG. 2 is an enlarged scale side elevational view of the heat exchanger portion of the furnace.

As later described herein the present invention provides a specially designed NOx reduction device 10 (schematically illustrated in FIG. 2) for incorporation in the combustion systems of fuel-fired heating appliances such as furnaces, water heaters and boilers. By way of example the NOx reduction device 10 is shown in FIGS. 1 and 2 as being operatively installed in the heat exchanger section 12 of a high efficiency fuel-fired heating furnace 14 as illustrated and described in U.S. Pat. No. 5,370,529.

Referring initially to FIGS. 1 and 2, the furnace 14 includes a generally rectangularly cross-sectioned housing 15 having vertically extending front and rear walls 16 and 18, and opposite side walls 20 and 22. Vertical and horizontal walls 24 and 26 within the housing 15 divide the housing interior into a supply plenum 28 (within which the heat exchanger 12 is positioned), a fan and burner chamber 30, and an inlet plenum 32 beneath the plenum 28 and the chamber 30.

Heat exchanger 12 includes three relatively large diameter, generally L-shaped primary combustor flame tubes 34 which are horizontally spaced apart and secured at their open inlet ends 36 to a lower portion of the interior vertical wall 24. As best illustrated in FIG. 2, each of the combustor tubes 34 has an essentially straight horizontal combustion section L extending inwardly from its inlet end 36. The upturned outlet ends 38 of the tubes 34 are connected to the bottom side of an inlet manifold 40 which is spaced rightwardly apart from a discharge manifold 42 suitably secured to an upper portion of the interior wall 24. The interior of the inlet manifold 40 is communicated with the interior of the discharge manifold 42 by means of a horizontally spaced series of vertically serpentined flow transfer tubes 44 each connected at its opposite ends to the manifolds 40,42 and having a considerably smaller diameter than the combustor tubes 34.

Three horizontally spaced apart "in-shot" type gas burners 46 are operatively mounted within a lower portion of the chamber 30 and are supplied with gaseous fuel (such as natural gas) through supply piping 48 by a gas valve 50. As can be seen in FIG. 2, each burner 46 is spaced outwardly apart from, and faces, the open inlet end 36 of its associated combustor tube 34. It will be appreciated that a greater or lesser number of combustor tubes 34, and associated burners 46 could be utilized, depending on the desired heating output of the furnace.

A draft inducer fan 52 positioned within the chamber 30 is mounted on an upper portion of the interior wall 24, above the burners 46, and has an inlet communicating with the interior of the discharge manifold 42, and an outlet section 54 that may be operatively coupled to an external exhaust flue (not shown).

Upon a demand for heat from the furnace 14, by a thermostat (not illustrated) located in the space to be heated, the burners 46 and the draft inducer fan 52 are energized. As best illustrated in FIG. 2, flames 57 and resulting hot products of combustion 58 from the burners 46 are directed into the open inlet ends 36 of the combustor tubes 34, and the combustion products 58 are drawn through the heat exchanger 12 by the operation of the draft inducer fan 52. Specifically, the burner combustion products 58 are drawn by the draft inducer fan, as indicated in FIG. 2, sequentially through the combustor tubes 34, into the inlet manifold 40, through the flow transfer tubes 44 into the discharge manifold 42, from the manifold 42 into the inlet of the draft inducer fan 52, and through the fan outlet section 54 into the previously mentioned exhaust flue to which the draft inducer outlet is connected.

At the same time return air 60 from the heated space is drawn upwardly into the inlet plenum 32 and flowed into the inlet of a supply air blower 61 disposed therein. Return air 60 entering the blower inlet is forced upwardly into the supply air plenum 28 through the illustrated opening in the interior housing wall 26. The return air 60 is then forced upwardly and externally across the heat exchanger 12 to convert the return air 60 into heated supply air 60a which is upwardly discharged from the furnace through its open top end to which a suitable supply ductwork system (not illustrated) is connected to flow the supply air 60*a* into the space to be heated.

Figure 4:
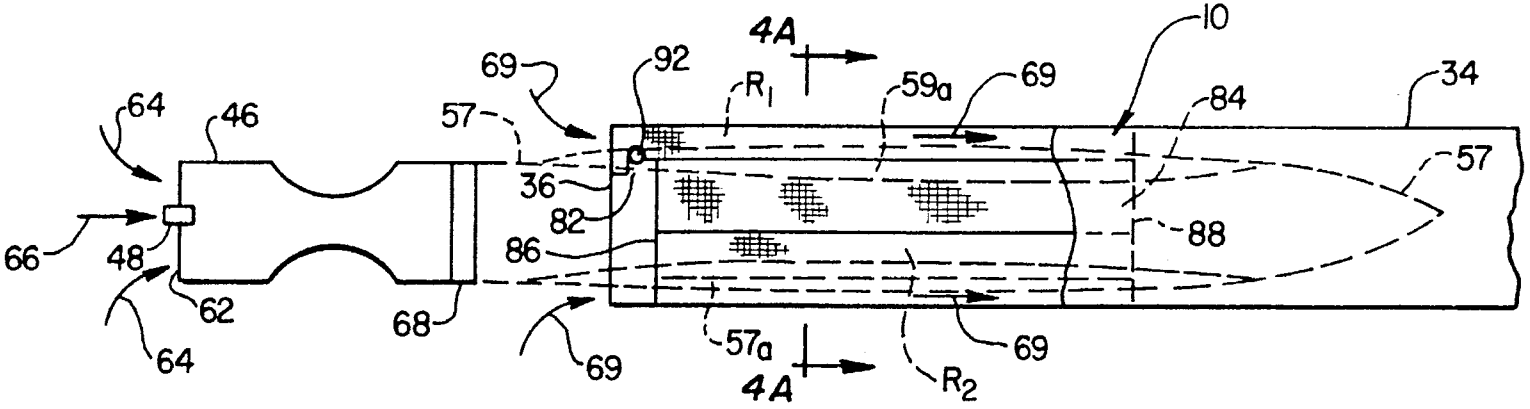
FIG. 4 is an enlarged scale, partly cut away side elevational view of the dotted area "A" of the heat exchanger combustor tube shown in FIG. 2 and illustrates the FIG. 3A NOx reduction insert device operatively installed therein.

With reference now to FIGS. 2 and 4, each of the illustrated inshot-type fuel burners 46 is of a conventional construction and has an open left or inlet end 62 into which primary combustion air 64 is drawn during burner operation for mixture and combustion with fuel 66 delivered to the burner through piping 48 to produce the flame 57 injected into the open combustor tube end 36 associated with the burner. At the right end of the burner 46 is a conventional flame holder structure 68 which is coaxial with its associated combustor tube inlet section 34. By aspiration, the injection of the flame 57 into the combustor tube 34 draws secondary combustion air 69 into the tube around the peripheral reactive zone 57*a* of the flame 57.

Figure 3A:
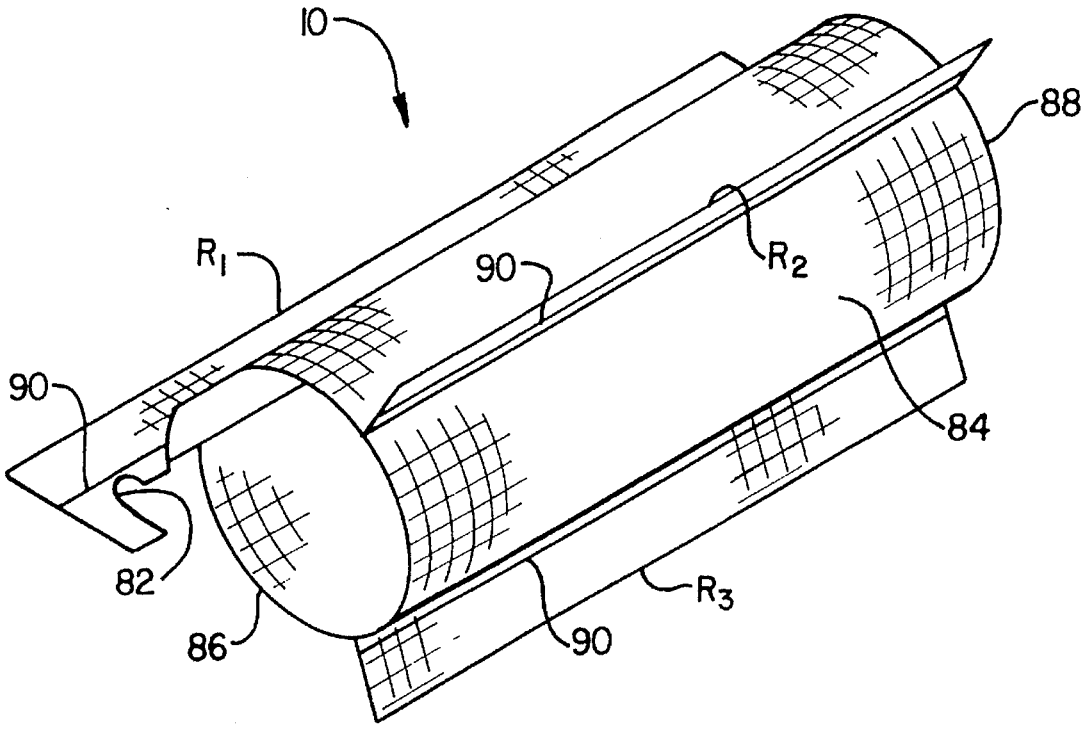
FIG. 3A is a perspective view of a specially designed NOx reduction insert device embodying principles of the present invention.
Figure 3B:
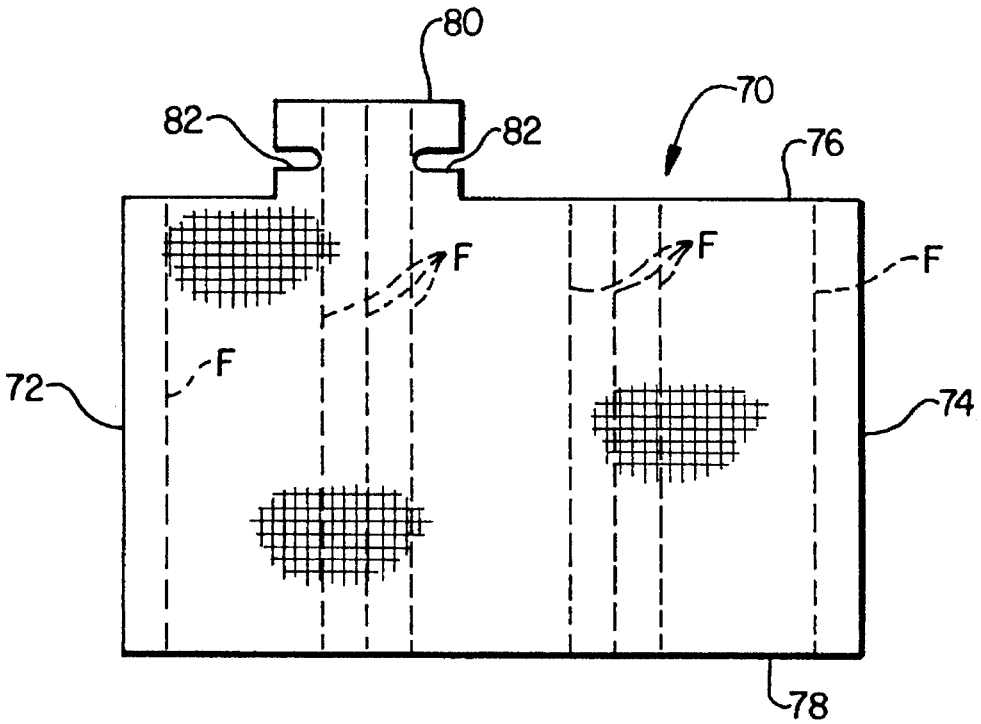
FIG. 3B is a developed side elevational view of the single metal wire mesh sheet used to form the FIG. 3A NOx reduction insert device.

Turning now to FIGS. 3A and 3B, in a preferred embodiment thereof the NOx reducing device 10 of the present invention (see FIG. 3A) is formed from a single rectangular sheet 70 (see FIG. 3B) of metal mesh material, representatively Iconel 601 wire mesh. Sheet 70 (FIG. 3A) has a pair of opposite end edges 72 and 74; a pair of opposite side edges 76 and 78; and a rectangular projection 80 extending outwardly from side edge 76 and having notches 82 formed in opposite side edges thereof. The NOx reducing device 10 (FIG. 3A) has a hollow tubular body portion 84 with opposite open ends 84,86 and a circular cross-section along its length. A circumferentially spaced plurality of exterior support ribs R1–R3 transversely project outwardly from the body portion 84.

The one-piece NOx reducing device 10 is formed by longitudinally bending the metal mesh sheet 70 to a circular shape (to form the tubular body portion 84) and folding the sheet along the parallel fold lines F to form, along the bent sheet, the ribs R1–R3. As can be seen, opposite end portions of the sheet 70 form the rib R3, with the other two folded areas between such end portions defining the ribs R1 and R2. To intersecure the two metal mesh layers that define each of the ribs, seam weld lines 90 are run along each of the ribs R1–R3 as indicated. Alternatively, a spot welding technique could be employed. The two notches 82 shown in FIG. 3B are aligned in the completed device 10 shown in FIG. 3A to form the notch 82 in the end portion of the Rib R1 that projects leftwardly beyond the open left end of the device body portion 84.

Figure 4A:
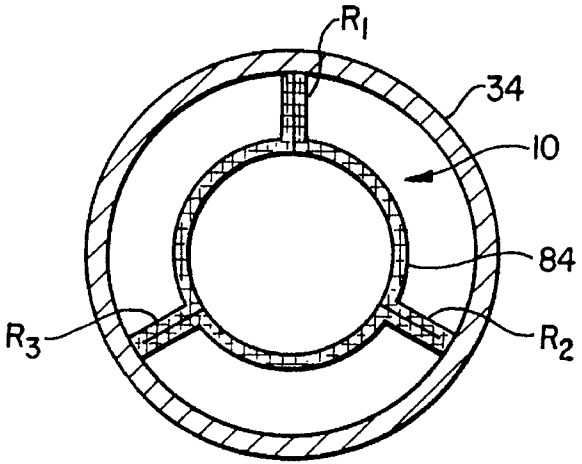
FIG. 4A is a cross-sectional view through the combustor tube, and the NOx reduction insert device installed therein, taken along line 4A—4A in FIG. 4.

Referring now to FIGS. 4 and 4A, the one piece NOx reducing device 10 is installed in an inlet end portion of the combustor tube 34 simply by coaxially inserting the device 10 into the tube 34 and then snapping the rib notch 82 onto a metal rod 92 transversely extending interiorly across the inlet end of the combustor tube 34. This coaxially positions the NOx reducing device body portion 84 within the tube 34 with the outer side edges of the ribs R1–R3 slidingly engaging the interior side surface of the combustor tube 34 to maintain the body portion 84 coaxially within the combustor tube 34 and permit substantially unrestrained thermal expansion and retraction of the inserted device 10 in an axial direction relative to the combustor tube 34.

The body portion 84 of the NOx reducing device 10 is position within the combustor tube 34 in a manner such that, as best illustrated in FIG. 4, during firing of the furnace 14 the peripheral reactive portion 57*a* of the burner flame 57 is axially intercepted and engaged by the body portion 84 of the NOx reducing device 10, thereby enhancing its NOx emission reduction effectiveness. Advantageously, the NOx reduction device 10 is of a one-piece construction in which the body 84 is formed integrally with the support ribs R1–R3, and the inserted device 10 is maintained in the necessary coaxial relationship with the combustor tube 34 regardless of the orientation of the tube 34. This eliminates the necessity of repositioning the support rod 92 to accommodate a reorientation of the combustor tube 34 in a different furnace heat exchanger section installation orientation.

Two representative alternate embodiments 10*a* and 10*b* of the previously described NOx reducing device 10 are illustrated in FIGS. 5A,5B and FIGS. 6A,6B respectively. For ease in comparing these two alternate embodiments to the device 10, portions in the device 10a similar to those in device 10 have been given reference numerals identical to those in device 10, but with the subscript "a"; and portions in the device 10*b* similar to those in device 10 have been given reference numerals identical to those in device 10, but with the subscript "b".

Figure 5A:
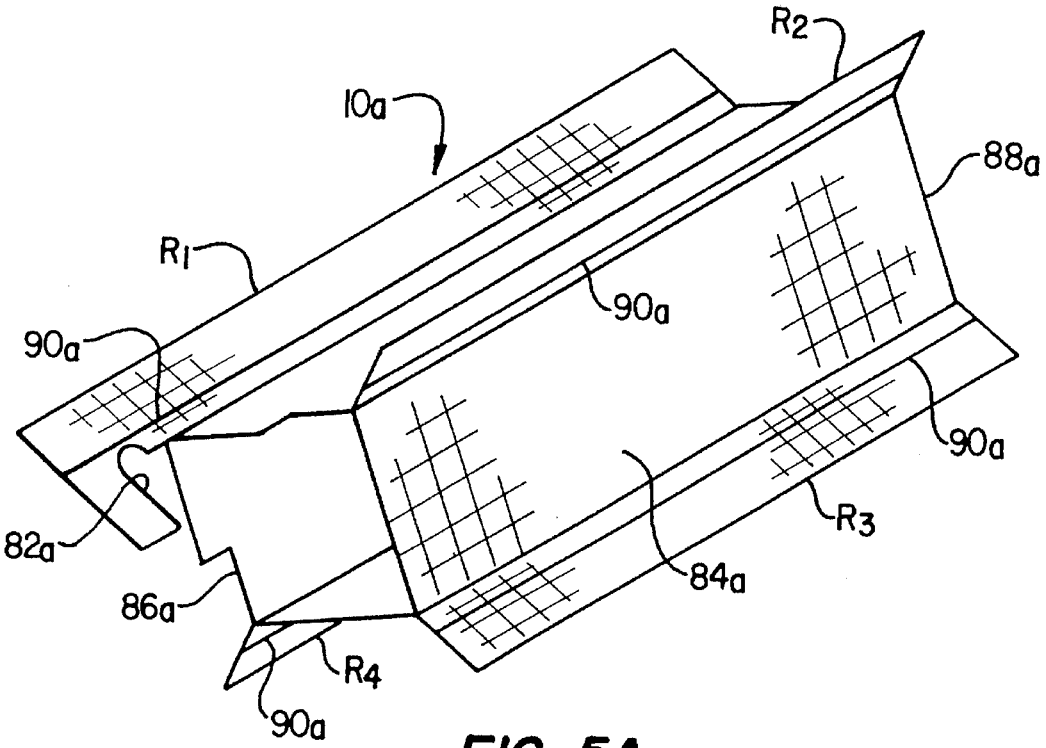
FIG. 5A is a perspective view of a first alternate embodiment of the FIG. 3A NOx reduction insert device.
Figure 5B:
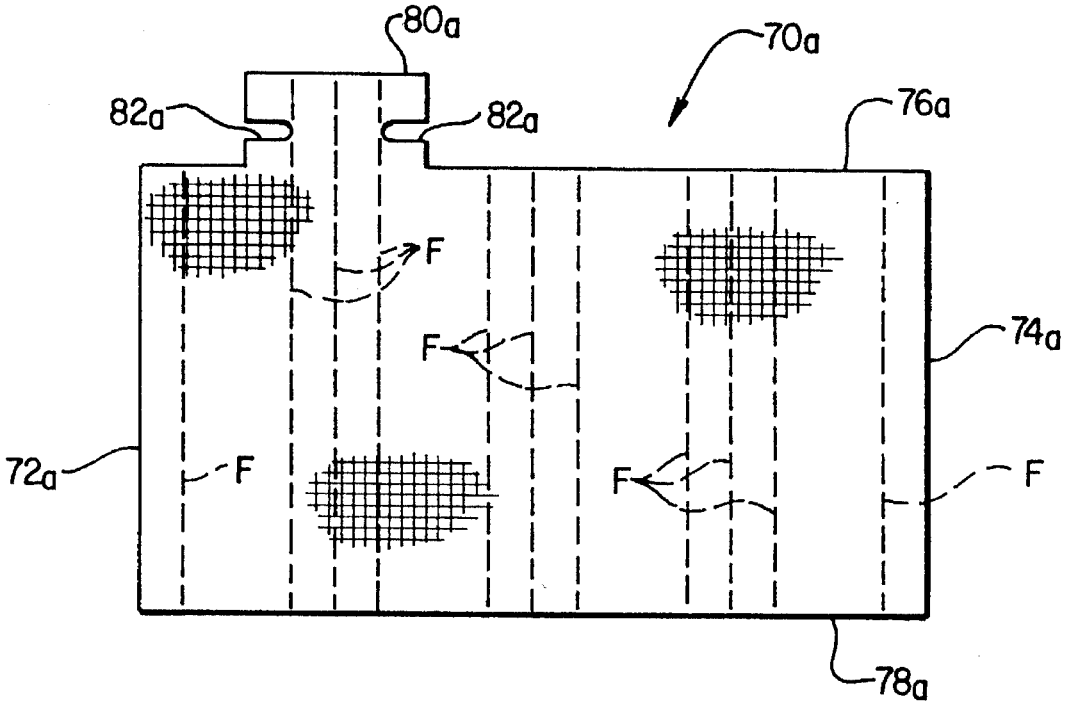
FIG. 5B is a developed side elevational view of the single metal wire mesh sheet used to form the FIG. 5A NOx reduction insert device.

Turning first to FIGS. 5A and 5B, the device 10*a* is made from a single sheet 70*a* of metal mesh material suitable bent and folded, along the lines F, to form in the device 10*a* a hollow, open ended body portion 84*a* having a rectangular cross-section along its length, with support ribs R1–R4 projecting outwardly from its four corners, and a rod-receiving notch 82*a* being defined in one projecting end portion of the rib R1. The two metal mesh layers forming each of the ribs R1–R4 are intersecured to one another by seam weld lines 90*a*. The NOx reducing device 10*a* may be installed in an inlet end portion of the combustor tube 34 in the same manner as the previously described device 10, with the body portion 84*a* similarly serving to axially intercept and contact the peripheral reactive flame portion 57*a*.

Figure 6A:
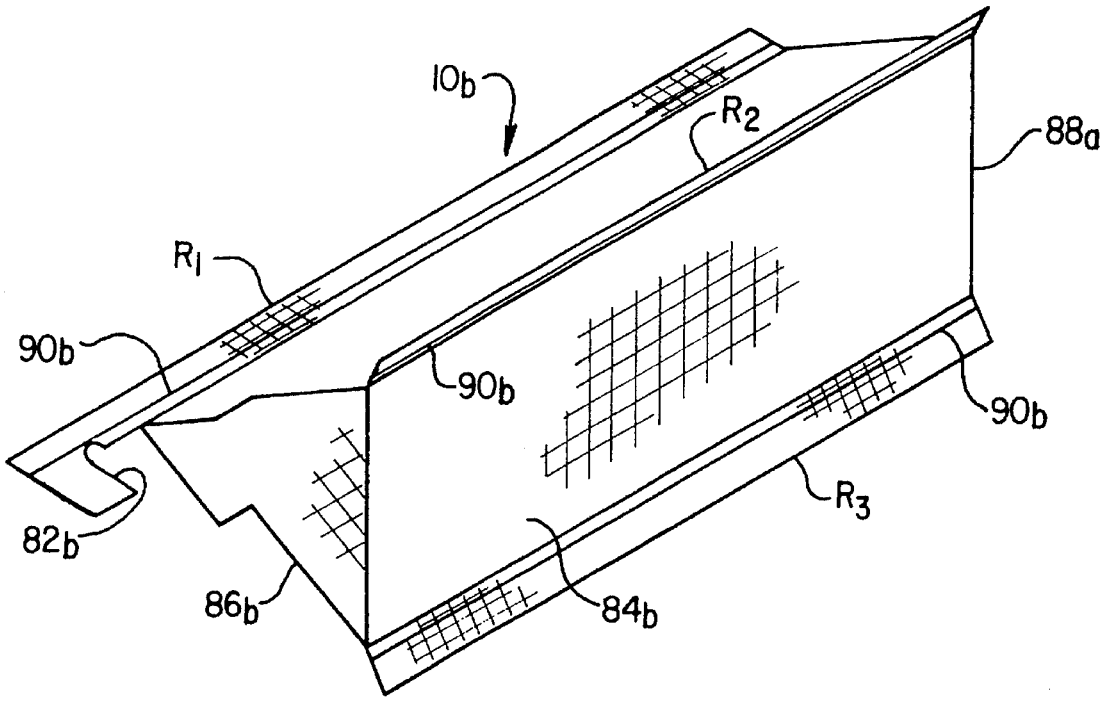
FIG. 6A is a perspective view of a second alternate embodiment of the FIG. 3A NOx reduction insert device.
Figure 6B:
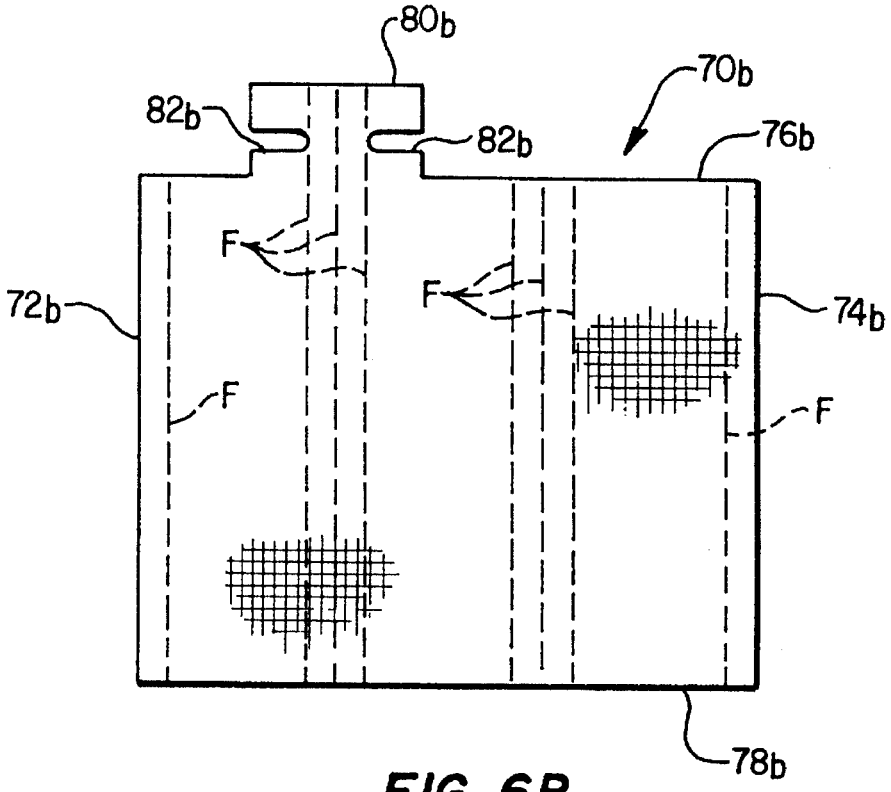
FIG. 6B is a developed side elevational view of the single metal wire mesh sheet used to form the FIG. 6A NOx reduction insert device.

The one piece NOx reducing insert device 10*b* shown in FIGS. 6A and 6B is similar to the device 10*a*, and is formed from a single sheet 70*b* of metal mesh material along fold lines F, but has a body portion 84*b* with a triangular cross-section along its length and outwardly projecting support ribs R–R3 at its corners. Device 10*b* may installed in the combustor tube 34 in the same manner, by snapping the rod 92 into the rib notch 82*b*, with the device body portion 84*b* axially intercepting and contacting the peripheral flame reactive portion 57*a*. In addition to the rectangular and triangular body portion cross-sections shown in FIGS. 5A and 6A, other convex polygonal body portion cross-sectional shaped could be employed if desired.

The foregoing detailed description is to be clearly understood as being given by way of illustration and example only, the spirit and scope of the present invention being limited solely by the appended claims.

What is claimed is:

1. A reduced NOx emission combustion system for a fuel-fired heating appliance, comprising:

a combustor tube having an open inlet end and an essentially straight combustion section longitudinally extending inwardly from said open inlet end and having an interior side surface;

a fuel burner operative to inject a flame and resulting hot combustion gases into said open inlet end for flow through said combustion section of said combustor tube in a manner drawing ambient combustion air into said combustion section around the flame; and apparatus for reducing the NOx emissions of the heating appliance during operation thereof, said apparatus including:

a NOx reducing insert member formed from a metal mesh material and having a hollow body portion extending lengthwise along an axis and opposite open ends longitudinally spaced apart along said axis, and a circumferentially spaced plurality of axially elongated ribs projecting laterally outwardly from said body portion, said NOx reducing insert member being received within said combustion section of said combustor tube with said ribs slidably engaging said interior side surface of said combustion section and maintaining said body portion in a coaxial, laterally inwardly spaced relationship with said combustion section, each of said ribs being defined by a different side-by-side duality of circumferential segments of said body portion secured to one another in a parallel, abutting relationship, and cooperatively engaged means on said combustion section and said NOx reducing insert member for preventing appreciable axial movement of said NOx reducing insert member within said combustion section.

2. The combustion system of claim 1 wherein:

said coperatively engaged means function to removably support said NOx reducing insert member within said combustion section of said combustor tube.

3. The combustion system of claim 2 wherein said cooperatively engaged means include:

an end portion of one of said ribs that has a notch formed therein, and a rod member extending transversely across said combustion section and received in said notch.

4. The combustion system of claim 1 wherein:

said fuel burner is an in-shot type fuel burner.

5. The combustion system of claim 1 wherein:

said hollow body portion of said NOx reducing insert member has a generally circular cross-section along its length.

6. The combustion system of claim 1 wherein:

said hollow body portion of said NOx reducing insert member has a convex polygonal cross-section along its length.

7. The combustion system of claim 6 wherein:

said hollow body portion of said NOx reducing insert member has a generally rectangular cross-section along its length.

8. The combustion system of claim 6 wherein:

said hollow body portion of said NOx reducing insert member has a generally triangular cross-section along its length.

9. The combustion system of claim 1 wherein:

said metal mesh material is Iconel 601 wire mesh.

10. The combustion system of claim 1 wherein:

said NOx reducing insert member is formed from a single sheet of metal mesh material.

11. The combustion system of claim 1 wherein:

the flame has a peripheral reaction zone, and the metal mesh material in said body portion of said NOx reducing insert member is positioned to axially intercept and contact the peripheral reaction zone of the flame.

12. A fuel fired forced air heating furnace comprising:

a housing;

a supply air blower operative to flow air to be heated through said housing;

a heat exchanger, interposed in the supply air blower air flow path, for transferring combustion heat to the air being flowed through said housing, said heat exchanger including a plurality of combustor tubes each having an open inlet end, an interior side surface, and an outlet end;

a plurality of in-shot type fuel burners disposed in facing orientations with said open inlet ends of said combustor tubes and operative to inject flames and resulting hot combustion gases thereinto in a manner drawing ambient combustion air into said open inlet ends of said combustor tubes around the flames traversing the interiors thereof;

a draft inducer fan having an inlet communicated with said outlet ends of said combustor tubes, said draft inducer fan being operative to draw hot combustion gases through said combustor tubes; and NOx reduction apparatus for reducing the NOx emission rate of said furnace, said NOx reduction apparatus including:

a plurality of NOx reducing insert members each formed from a metal mesh material and having a hollow body portion extending lengthwise along an axis and opposite open ends longitudinally spaced apart along said axis, and a circumferentially spaced plurality of axially elongated ribs projecting laterally outwardly from said body portion, said NOx reducing insert members being received within inlet end portions of said combustor tubes, with said ribs slidably engaging said interior side surfaces of said inlet end portions and maintaining said body portions in coaxial, laterally inwardly spaced relationships with their associated inlet end portions of said combustor tubes, each of said ribs being defined by a different side-by-side duality of circumferential segments of said body portion secured together in a parallel, abutting relationship, and cooperatively engaged means on said inlet end portions of said combustor tubes and said NOx reducing insert members for preventing appreciable axial movement of said NOx reducing members relative to their associated inlet end portions of said combustor tubes.

13. The furnace of claim 12 wherein:

said cooperatively engaged means function to removably support said NOx reducing insert members in their associated inlet end portions of said combustor tubes.

14. The furnace of claim 13 wherein, for each NOx reducing insert member and its associated combustor tube, said cooperatively engaged means include:

an end portion of one of said ribs that has a notch formed therein, and a rod member extending transversely across the inlet end portion of the combustor tube and received in said notch.

15. The furnace of claim 12 wherein:

said hollow body portions of said NOx reducing insert members have generally circular cross-sections along their lengths.

16. The furnace of claim 12 wherein:

said hollow body portions of said NOx reducing insert members have convex polygonal cross-sections along their lengths.

17. The furnace of claim 16 wherein:

said hollow body portions of said NOx reducing insert members have generally rectangular cross-sections along their lengths.

18. The furnace of claim 16 wherein:

said hollow body portions of said NOx reducing insert members have generally triangular cross-sections along their lengths.

19. The furnace of claim 12 wherein:

said metal mesh material is Iconel 601 wire mesh.

20. The furnace of claim 12 wherein:

each of said NOx reducing insert members is formed from a single sheet of metal mesh material.

21. The furnace of claim 12 wherein:

the flames have peripheral reaction zones, and the metal mesh material in said body portions of said NOx reducing insert members is positioned to axially intercept and contact the peripheral reaction zones of the flames.

22. A NOx reducing insert member positionable within an inlet end portion of a fuel-fired appliance combustor tube having an interior side surface and into which a burner flame may be injected, said NOx reducing insert member being formed from a single, bent sheet of metal mesh material and having:

a hollow body portion extending lengthwise along an axis and opposite open ends spaced apart along said axis; and a circumferentially spaced plurality of support ribs integral with said body portion, said support ribs longitudinally extending along the exterior of said hollow body portion parallel to said axis and laterally projecting outwardly from said hollow body portion, each of said support ribs being defined by a folded portion of said sheet of metal mesh material having an opposing pair of metal mesh layers anchored to one another in a parallel, abutting relationship, one of said support ribs longitudinally projecting beyond one of said open ends of said hollow body portion and having a side edge notch therein.

23. The NOx reducing insert member of claim 22 wherein:

said hollow body portion has a generally circular cross-section along its length.

24. The NOx reducing insert member of claim 22 wherein:

said hollow body portion has a convex polygonal cross-section along its length.

25. The NOx reducing insert member of claim 24 wherein:

said hollow body portion has a generally rectangular cross-section along its length.

26. The NOx reducing insert member of claim 24 wherein:

said hollow body portion has a generally triangular cross-section along its length.

27. The NOx reducing insert member of claim 22 wherein:

said single sheet of metal mesh material is a sheet of Iconel 601 wire mesh.

* * * * *